US010240429B2

(12) United States Patent
Rogozinski et al.

(10) Patent No.: US 10,240,429 B2
(45) Date of Patent: Mar. 26, 2019

(54) ROTARY SLEEVE TO CONTROL ANNULAR FLOW

(71) Applicant: Halliburton Energy Services, Inc., Houston, TX (US)

(72) Inventors: Nicolas Rogozinski, Spring, TX (US); Henry Eugene Rogers, Oklahoma City, OK (US); Samuel Travis McMillian, Huntsville, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/563,442

(22) PCT Filed: Jun. 29, 2015

(86) PCT No.: PCT/US2015/038339
§ 371 (c)(1),
(2) Date: Sep. 29, 2017

(87) PCT Pub. No.: WO2017/003429
PCT Pub. Date: Jan. 5, 2017

(65) Prior Publication Data
US 2018/0066498 A1 Mar. 8, 2018

(51) Int. Cl.
*E21B 33/16* (2006.01)
*E21B 34/00* (2006.01)

(52) U.S. Cl.
CPC ..... *E21B 33/16* (2013.01); *E21B 2034/002* (2013.01)

(58) Field of Classification Search
CPC ..... E21B 33/16; E21B 2034/002
See application file for complete search history.

(56) References Cited

U.S. PATENT DOCUMENTS 4,415,037 A 11/1983 Brooks
4,967,844 A 11/1990 Brooks et al.
6,904,970 B2 6/2005 Simson
(Continued)

FOREIGN PATENT DOCUMENTS

WO 2005019596 A1 3/2005

OTHER PUBLICATIONS

International Search Report and Written Opinion dated Dec. 15, 2015; International PCT Application No. PCT/US2015/038339.

*Primary Examiner* — D. Andrews
*Assistant Examiner* — Yanick A Akaragwe
(74) *Attorney, Agent, or Firm* — McGuireWoods LLP

(57) ABSTRACT

A wellbore completion system includes a container for delivering plugs or other objects to a wellbore. The container includes a sleeve having a sealing surface at a first end and a geared interface at a second, opposing end. The sealing surface includes voids or apertures that align with or obstruct apertures in a diverter plate, depending on the position of the sleeve, to permit or obstruct annular flow around the sleeve, respectively. A ball valve is coupled to the second, opposing end of the sleeve, and has a valve-geared interface that engages the geared interface of the sleeve. A releasable object, such as a cement wiper plug, may be stored within the conduit of the sleeve. The geared interface relates movement of the ball valve to movement of the sleeve, resulting in simultaneous opening of the valve, closing of the annular flow path, and release of the releasable object.

16 Claims, 7 Drawing Sheets

(56) References Cited

U.S. PATENT DOCUMENTS

| | | | | |
|---|---|---|---|---|
| 8,256,515 | B2 | 9/2012 | Barbee | |
| 8,381,808 | B2 | 2/2013 | Rogers et al. | |
| 8,403,063 | B2 * | 3/2013 | Inglis | E21B 34/14 166/316 |
| 8,695,715 | B2 | 4/2014 | Rogers et al. | |
| 9,957,773 | B1 * | 5/2018 | Barbee, Jr. | E21B 33/16 |
| 2010/0108325 | A1 | 5/2010 | Solland | |
| 2014/0262532 | A1 | 9/2014 | Mizuguchi | |
| 2017/0342803 | A1 * | 11/2017 | Clement | E21B 34/14 |

* cited by examiner

ROTARY SLEEVE TO CONTROL ANNULAR FLOW

BACKGROUND

The present disclosure relates to oil and gas exploration and production, and more particularly to a subassembly for storing and releasing a wiper plug into a work string.

Wells are drilled at various depths to access and produce oil, gas, minerals, and other naturally-occurring deposits from subterranean geological formations. Hydrocarbons may be produced through a wellbore traversing the subterranean formations. Under certain subterranean conditions, completing a well to produce hydrocarbons involves applying cement to a wellbore or wellbore casing.

In a cementing operation, cement may be delivered downhole through a work string and circulated back uphole in an annular space between a casing and wellbore wall. In some instances, multiple segments of the annular space may be cemented in different stages. Prior to starting cementing operations in all or a segment of a wellbore, it may be desirable to prepare the well for cementing by removing debris from the wellbore and separating the cement from other fluids in the wellbore. Similarly, following cementing, it may be desirable to clear the work string and inside of the casing of cement prior to resuming formation or completion operations.

To prepare the wellbore and prevent the cement from mixing with other fluids, a spacer fluid followed by cementing plugs or darts may be released downhole in advance of the cement flow. To clear the work string and casing, a second plug or dart may be released after the cement to wipe clear the inside of the work string and casing.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION OF ILLUSTRATIVE EMBODIMENTS

Figure 1A:
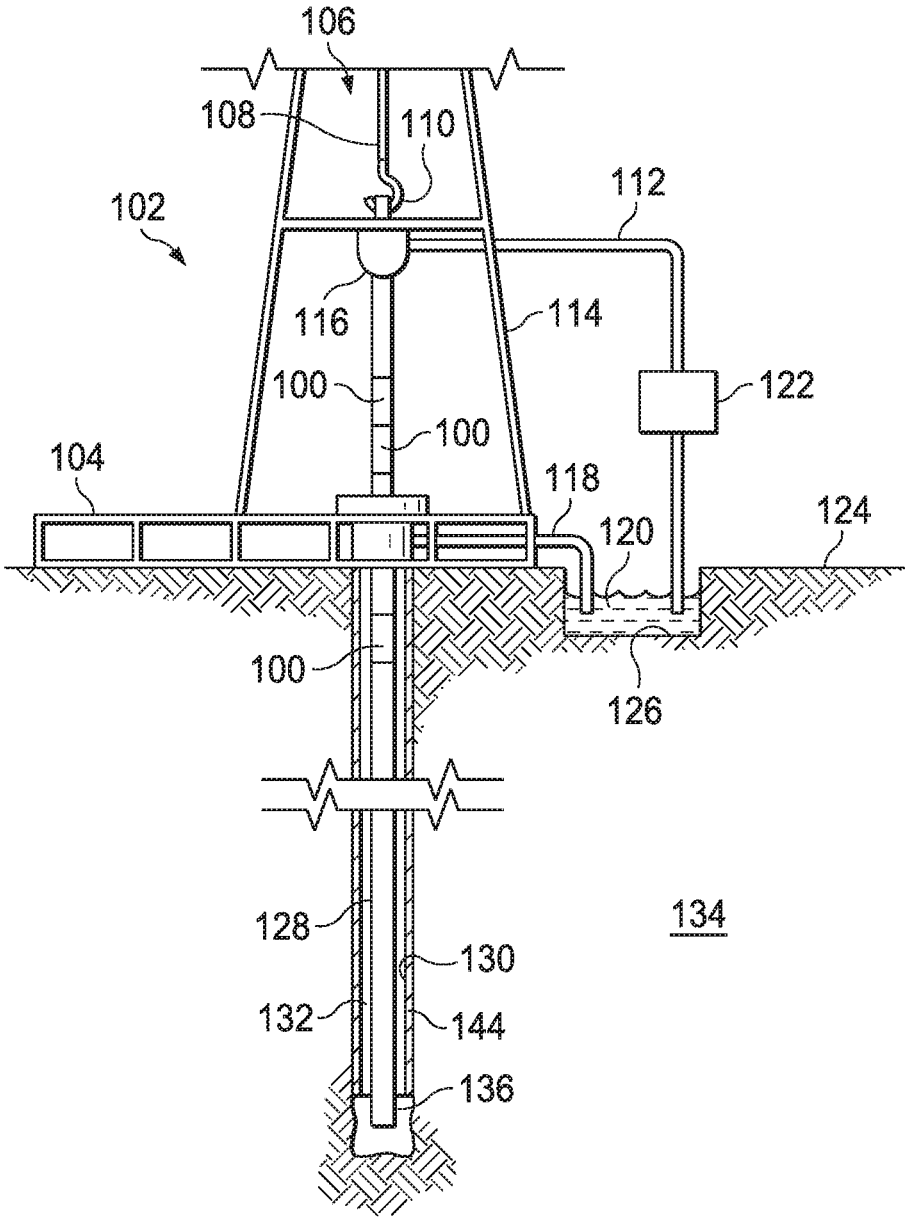
FIG. 1A illustrates a schematic view of an on-shore well in which a completion work string is deployed according to an illustrative embodiment.

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to". Unless otherwise indicated, as used throughout this document, "or" does not require mutual exclusivity.

As noted above, plugs may be used during cementing operations to help remove dispersed mud (drilling fluid) and mud sheath from the inner surface of a casing and to minimize the contamination of cement. In a typical cementing operation, a bottom plug is pumped through a work string and casing ahead of the cement slurry and behind a spacer fluid. The bottom plug wipes dispersed mud from the inner diameter of the casing as it moves down the string and prevents mixing between the cement and the spacer fluid. When the bottom plug seats at a float collar at the bottom of the casing, differential pressure ruptures a diaphragm on the plug, allowing cement to flow through the plug, turn the corner at the bottom of the casing and fill the annular space between the casing and the formation. To clear the inside of the casing after pumping of the full volume of cement, a top plug is dropped and pumped behind the cement slurry. The top plug wipes cement from the inner diameter of the casing and then seats at the float collar, resting on the bottom plug and causing a pressure increase at the surface indicating that the cement has been displaced from the inside of the casing.

The present disclosure describes completion systems that facilitate cementing operations by allowing plugs, darts, or other objects to be delivered from a container subassembly to a downhole segment of casing or wellbore.

In an illustrative embodiment, the subassembly may function as a plug container, or as a plurality of plug containers for dispensing one or more plugs, darts, balls, or other objects prior to or following the application of cement to a wellbore. The container subassembly may release cement wiper plugs, for example, to a segment of casing or work string downhole from the subassembly upon actuation of a valve and flow diverter. In an embodiment, actuation of the valve and flow diverter results in flow being diverted from an annular flow path to a main bore flow path, which in turn allows the fluid to carry plugs or other objects from the container.

As described in more detail below, the subassembly or plug container may have an internal rotational sleeve that is operable to provide a fluid flow path through a main bore of the subassembly. The sleeve may be disposed within an outer sleeve, forming an alternative annular flow path through an annulus formed between the sleeve and outer sleeve. The internal, or inner sleeve, may house plugs or dart for subsequent delivery downhole. In an embodiment, the inner sleeve is coupled to a ball valve. When the valve is closed, the valve will impede the dart or plugs from being released from the inner sleeve. When the valve is opened, however, the valve permits flow through the main bore of the sleeve and releases the dart or plugs previously stored within the sleeve.

The sleeve and valve may be interconnected by a keyed interface, gears, or interlocking protrusions at the end of the sleeve and complementary keys or protrusions inserted on the ball of the valve. At the opposite end of the tube from the geared interface, a flange, which may comprise a plurality of fins, center the sleeve inside of the outer sleeve of the plug container subassembly. The fins or flange may be fixed to the tube or inner sleeve and therefore rotate about the longitudinal axis of the sleeve as the sleeve is rotated.

As previously noted, placement of the sleeve inside of the outer sleeve of the plug container subassembly creates an annulus between the sleeves where fluid flow is directed when flow through the main bore is restricted by the valve. Direction of the flow to the annulus may be accomplished by adding a diverter to the subassembly that is fixed relative to the outer sleeve at the end of the plug container opposite the valve. This configuration results in flow being permitted through the annulus when the valve is closed and flow being restricted through the annulus when the valve is open, and the two flow paths simultaneously transitioning from being opened and closed (and vice versa). The plug container subassembly is described in more detail in the following disclosure with regard to FIGS. 1A-8.

Figure 1B:
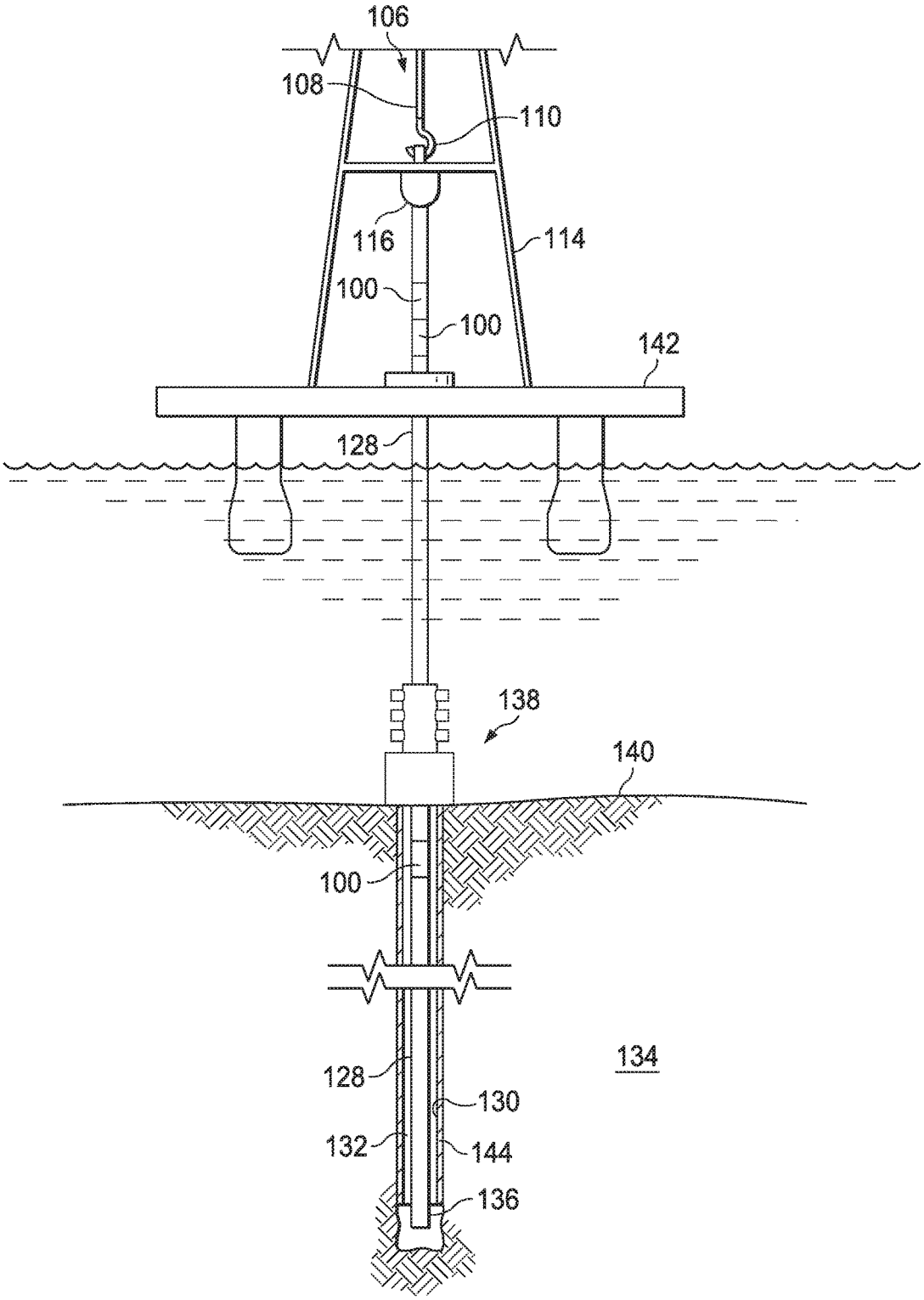
FIG. 1B illustrates a schematic view of an off-shore well in which a completion work string is deployed according to an illustrative embodiment.

Referring now to the figures, FIG. 1A illustrates a schematic view of a rig 104 in which a work string 128 is deployed. The work string 128 includes one or more instances of a container subassembly 100 in accordance with an illustrative embodiment. The rig 104 is positioned at a surface 124 of a well 102. The well 102 includes a wellbore 130 that extends from the surface 124 of the well 102 to a subterranean substrate or formation 134. The well 102 and rig 104 are illustrated onshore in FIG. 1A. Alternatively, FIG. 1B illustrates a schematic view of an off-shore platform 142 operating a work string 128 that also includes one or more instances of container subassembly 100 according to an illustrative embodiment. Thus, the container subassembly 100 in FIG. 1B may be deployed in a sub-sea well 138 accessed by the offshore platform 142. The offshore platform 142 may be a floating platform or may instead be anchored to a seabed 140.

FIGS. 1A-1B each illustrate possible uses or deployments of the container subassembly 100, and while the following description of the container subassembly 100 primarily focuses on the use of the subassembly 100 during a cementing operation, the subassembly 100 also may be used in other stages well formation, completion, or operations where it may be desired to divert flow from a first flow path to second flow path within the wellbore, or to release an object into a fluid flow path through a work string.

In the embodiments illustrated in FIGS. 1A and 1B, the wellbore 130 has been formed by a drilling process in which dirt, rock and other subterranean material was removed to create the wellbore 130. During or after the drilling process, a portion of the wellbore may be cased with a casing 144. In other embodiments, the wellbore 130 may be maintained in an open-hole configuration without casing 144. The embodiments described herein are applicable to either cased or open-hole configurations of the wellbore 130, or a combination of cased and open-hole configurations in a particular wellbore.

After drilling of the wellbore 130 is complete and the associated drill bit and drill string are "tripped" from the wellbore 130, the work string 128 which may eventually function as a production string is lowered into the wellbore 130. The work string 128 may include sections of tubing, each of which are joined to adjacent tubing by threaded or other connection types. The work string may refer to the collection of pipes or tubes as a single component, or alternatively to the individual pipes or tubes that comprise the string. The term work string (or tubing string or production string) is not meant to be limiting in nature and may refer to any component or components that are capable of being coupled to the container subassembly 100 to lower or raise the container subassembly 100 in the wellbore 130 or to provide energy to the container subassembly 100 such as that provided by fluids, electrical power or signals, or mechanical motion. Mechanical motion may involve rotationally or axially manipulating portions of the work string 128. In some embodiments, the work string 128 may include a passage disposed longitudinally in the work string 128 that is capable of allowing fluid communication between the surface 124 of the well 102 and a downhole location 136.

The lowering of the work string 128 may be accomplished by a lift assembly 106 associated with a derrick 114 positioned on or adjacent to the rig 104 or offshore platform 142. The lift assembly 106 may include a hook 110, a cable 108, a traveling block (not shown), and a hoist (not shown) that cooperatively work together to lift or lower a swivel 116 that is coupled an upper end of the work string 128. The work string 128 may be raised or lowered as needed to add additional sections of tubing to the work string 128 to position the distal end of the work string 128 at the downhole location 136 in the wellbore 130.

A reservoir 126 may be positioned at the surface 124 to hold a fluid 120 for delivery to the well 102 during setting or operation of the container subassembly 100. A supply line 112 is fluidly coupled between the reservoir 126 and the passage of the work string 128. A pump 122 drives the fluid 120 through the supply line 112 and the work string 128 toward the downhole location 136. As described in more detail below, the fluid 120 may comprise a cement slurry for application in a cementing operation (as described above), or an alternative fluid that is used to carry debris from the wellbore 130 prior to or during the completion process. After traveling downhole, the fluid 120 or portions thereof returns toward the surface 124 by way of an annulus 132 between the work string 128 and the wellbore 130 or, in the case of a cementing operation, an annulus between the casing 144 and wellbore 130. At the surface 124, any fluid that exits the wellbore 130 may be collected or returned to the reservoir 126 through a return line 118.

Figure 2:
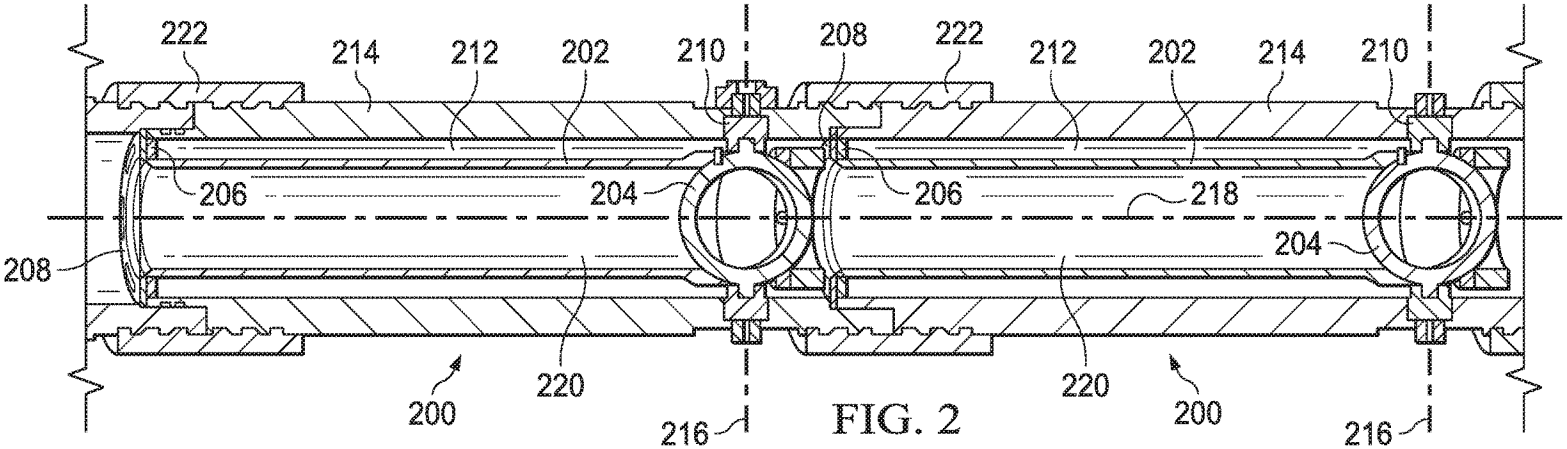
FIG. 2 illustrates a schematic, cross-section view of a plug container subassembly that may be used in a completion work string in accordance with an illustrative embodiment.
Figure 7:
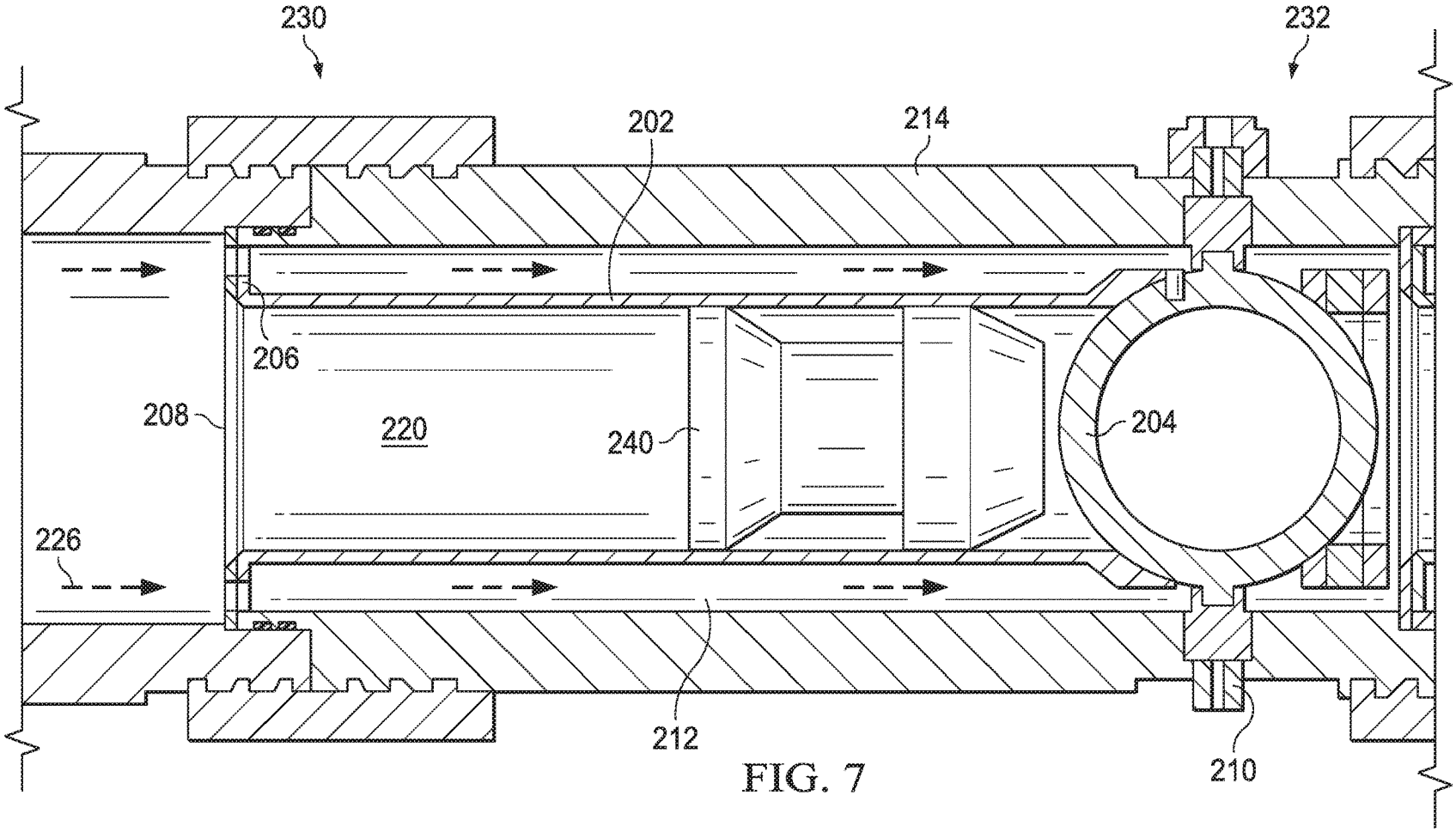
FIG. 7 illustrates a schematic, cross-section view of the container subassembly of FIG. 2, wherein the valve ball is positioned to restrict flow through a main bore of the subassembly, thereby retaining a plug, and wherein the inner sleeve is positioned to permit flow through an annulus between the inner sleeve and an outer sleeve.
Figure 8:
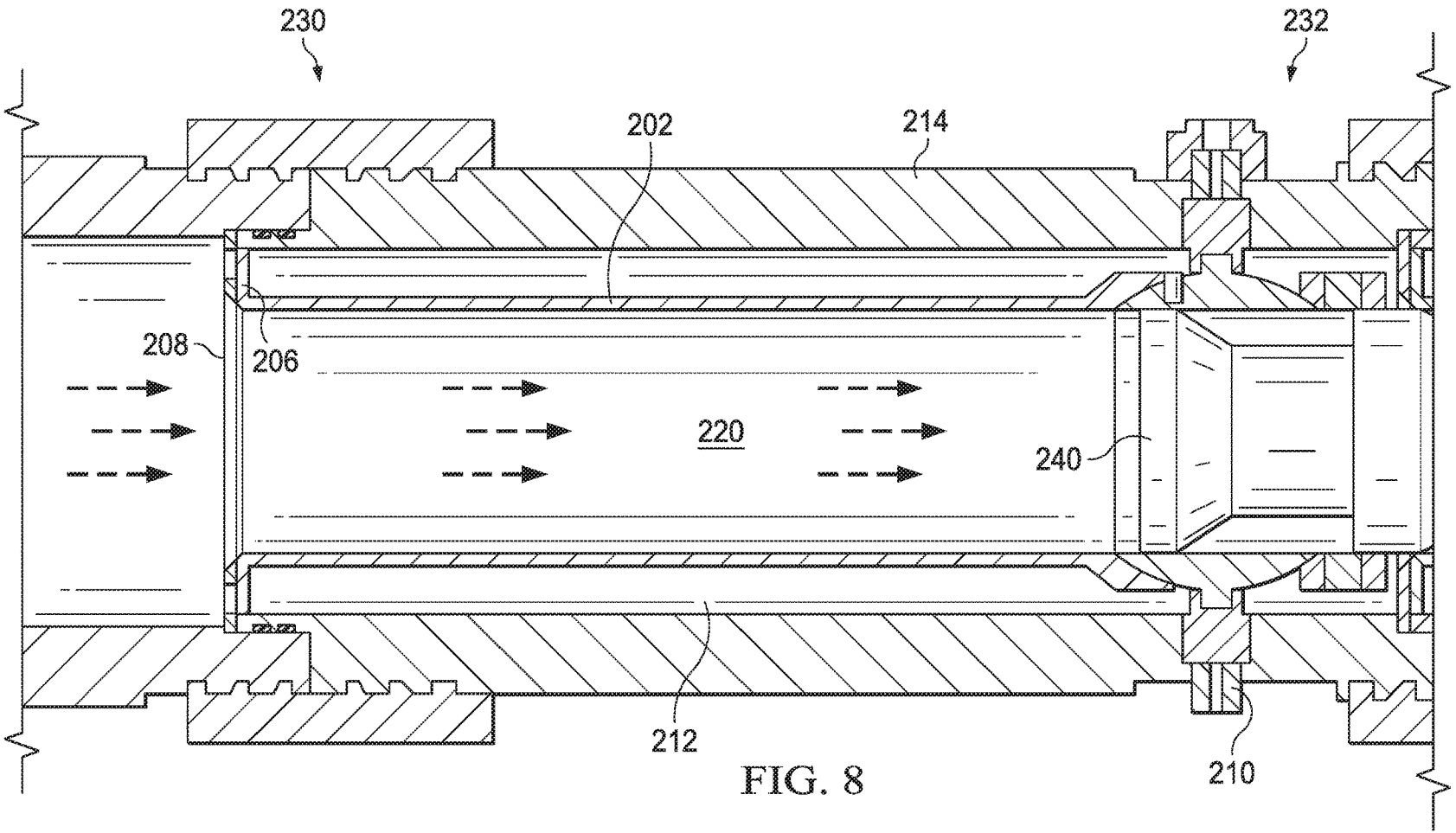
FIG. 8 illustrates a schematic, cross-section view of the container subassembly of FIG. 7, wherein the valve ball is positioned to permit flow through a main bore of the subassembly, thereby releasing the plug, and wherein the inner sleeve is positioned to restrict flow through the annulus between the inner sleeve and outer sleeve.

In accordance with an illustrative embodiment, the completion subassembly includes one or more subassemblies 200, as shown in FIGS. 2, 7, and 8, which may be connected in series or placed at multiple locations in the work string to controllably house and dispense plugs, or other objects or particles downhole. The subassemblies 200 are shown as being connected in series in FIG. 2. Each subassembly 200 includes an outer sleeve 214, which is connected in series with other elements in the work string by a coupler 222. To engage the coupler 222, each end of the outer sleeve 214 may include a threaded surface or any other suitable coupling feature that may be used to join two segments of pipe. An inner sleeve, sleeve 202, is disposed within, and shares a common longitudinal axis 218 with the outer sleeve 214. An annulus 212 is formed between the outer surface of the sleeve 202 and the inner surface of the outer sleeve 214. The annulus 212 may provide an annular fluid flow path in certain configurations of the subassembly 200. Similarly, a main bore 220 of the sleeve 202 may provide an alternative flow path through the subassembly 200 in other configurations.

The sleeve 202 has a flange 206 at a first end, which may be formed integrally to the sleeve 202 or affixed to the sleeve 202 using a mechanical coupling, such as a threaded interface, mechanical fasteners, a press-fit joint, braze, weld, or combination thereof. In an embodiment, the outer diameter of the flange 206 may be approximately equal to, or only nominally less than the inner diameter of the outer sleeve 214 to center the sleeve 202 within the outer sleeve 214 at the first end of each sleeve. The sleeve 202 is rotatable about the longitudinal sleeve axis 218 within the outer sleeve 214. In an embodiment, other centering features, such as longitudinal fins or positioning arms may be included to center the sleeve 202 within the outer sleeve 214.

A diverter plate 208 is affixed to the first end of the outer sleeve 214 approximately adjacent to the flange 206 of the sleeve 202. In an embodiment, a thrust washer, thrust bearing, or similar device may be installed between the diverter plate 208 and flange 206 to facilitate rotational movement of the sleeve 202 relative to the diverter plate 208. The thrust washer may be fixed relative to the flange 206 or diverter plate 208, and may have apertures that align with apertures in the flange 206 or diverter plate 208, accordingly.

In an embodiment, materials for the sleeve 202, diverter plate 208 and a valve ball of a valve 204 may be selected to minimize friction. Similarly, a reduced-friction coating or surface treatment may be applied to the interface of the sleeve 202 and diverter plate 208 and to the interface between the sleeve 202 and valve 204 to reduce friction and enhance sealing between such components.

In an embodiment, the diverter plate 208 is fastened to the outer sleeve 214 by any suitable joint, such as a weld, mechanical fasteners, adhesives, or by a threaded interface whereby threads on the inner surface of the outer sleeve 214 engage threads on the outer circumference of the diverter plate 208. As described in more detail below with regard to FIG. 6, the diverter plate 208 includes a central aperture and diverter apertures. Similarly, the flange 206 includes complementary apertures or alternating fins, as described with regard to FIG. 3, that form sealing surfaces and voids. The voids provide a fluid flow path from a tubing segment coupled to the first end 230 of the subassembly 200 to the annulus 212 when the voids or complementary apertures of the flange 206 are aligned or partially aligned with the diverter apertures. Alternatively, the one or more sealing surfaces of the flange 206 may restrict flow to the annulus 212 when the sealing surfaces are aligned with, or obstructing, the diverter apertures of the diverter plate 208.

At a second end 232 of the subassembly 200, a valve 204 is coupled to the outer sleeve 214. Here, the valve 204 is a ball valve having a valve ball that is operable to permit flow through the main bore conduit 220 when an aperture in the valve ball is aligned with the conduit 220 in an open state. Similarly, the valve 204 is operable to restrict flow through the conduit 220 when the valve ball is rotated about a valve axis 216 that may be perpendicular to the longitudinal axis 218 of the outer sleeve 214. In an embodiment, the valve 204 is a remotely actuated valve having a controller 210 that is operable to open and close the valve 204 in response to a preselected condition, or in response to receiving a control signal. The control signal may be any suitable control signal, such as a pressure pulse, a wired signal, or a telemetry signal. As described in more detail below, the valve ball of the valve 204 may include interlocking features that engage the sleeve 202, thereby causing the sleeve 202 to rotate about the longitudinal sleeve axis 218 in proportion to the valve ball's rotation about the valve axis 216.

Figure 3:
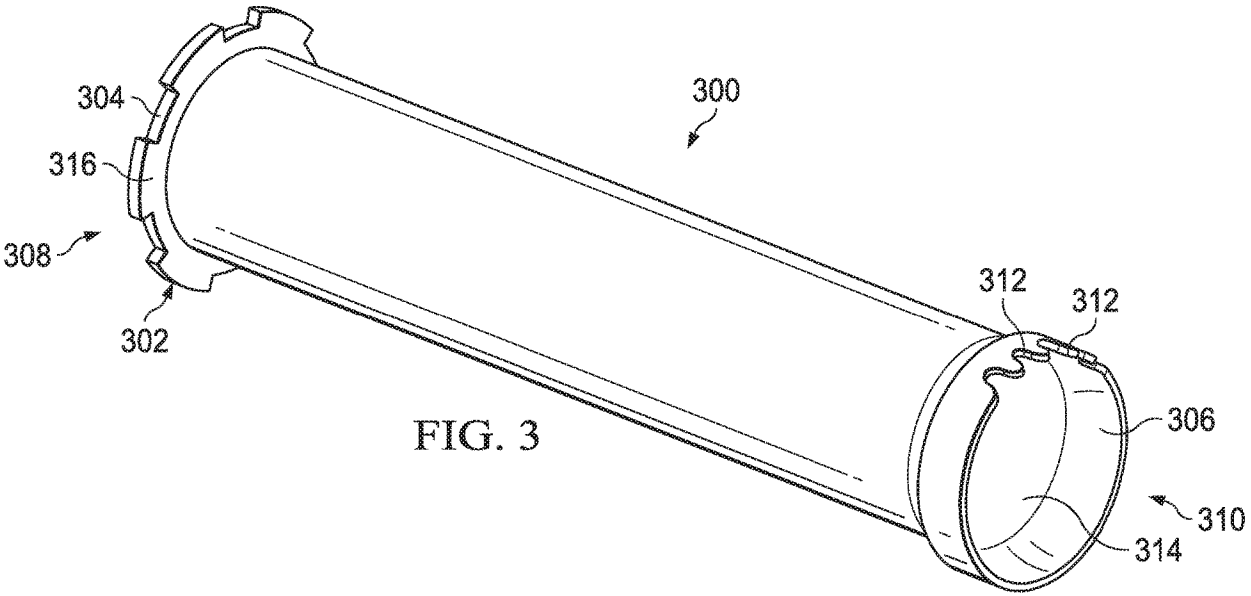
FIG. 3 illustrates a perspective view of an embodiment of a sleeve used in the container subassembly of FIG. 2.

FIG. 3 shows an illustrative embodiment of an inner sleeve 300, which is analogous to the sleeve 202 of FIG. 2. The sleeve 300 includes a flange 302 at a first end 308. The flange 302 includes one or more sealing surfaces 316 and voids 304. The sealing surfaces 316 may be sized to be as large or larger than diverter apertures in the diverter plate 208 to substantially cover and occlude the diverter apertures when the sealing surfaces 316 are aligned with, or are overlying the diverter apertures. Similarly, the voids 304 may be sized to be as large or larger than diverter apertures in the diverter plate 208 to provide a flow path having a cross section that is of substantially the same area as the diverter apertures when the voids 304 are aligned with, or are overlying the diverter apertures.

In an alternative embodiment, the flange 302 may include flange apertures that encompass and are larger than, or that are of substantially the same shape as, the diverter apertures. In either such embodiment, the flange apertures provide a flow path having a cross section that is of substantially the same area as the diverter apertures when the flange apertures are aligned, overlying, or otherwise not obstructing the diverter apertures. In any such embodiment, the portion of the flange 302 that does not include the flange apertures may act as a single sealing surface.

At a second end 310, the sleeve 300 includes recesses 312 or teeth that are sized and configured to interlock with complementary protrusions or teeth on a complementary surface, such as the outer surface of the valve ball of ball valve 204. To center the sleeve 300 relative to a ball valve and accordingly, relative to a subassembly that includes the ball valve, the sleeve 300 may include an inner arcuate surface 306 at the second end 310 to complement and engage an outer surface of a valve ball. The sleeve 300 also includes an inner conduit 314 that provides a fluid flow path through the sleeve 300. In some embodiments, additional centering members, such as centering arms or longitudinal fins, may be placed along the external surface of the sleeve 300 to center the sleeve 300 within an outer sleeve when assembled.

Figure 4:
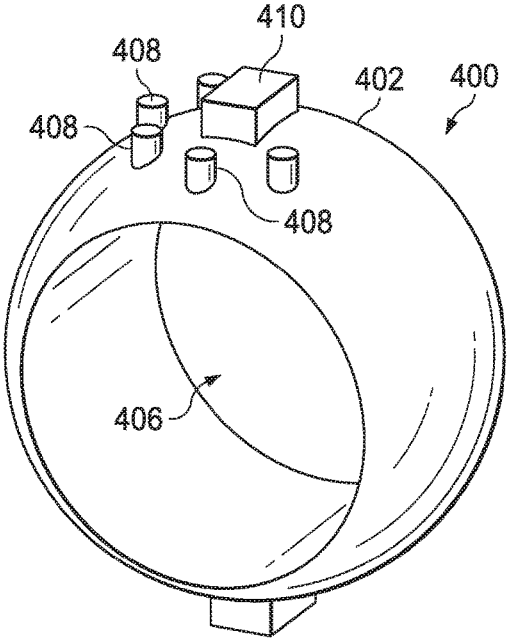
FIG. 4 illustrates a perspective view of an embodiment of a valve ball used in a ball valve of the container subassembly of FIG. 2.
Figure 5:
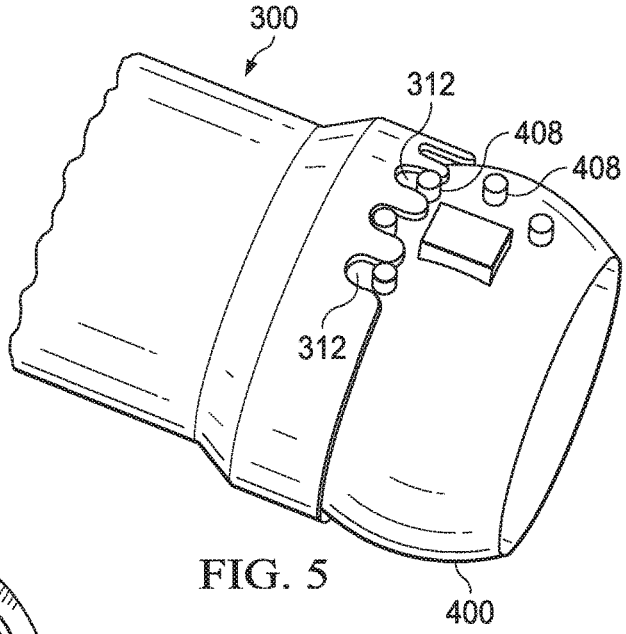
FIG. 5 illustrates a perspective view of an interface between the inner sleeve of FIG. 3 and the valve ball of FIG. 4.

An embodiment of a valve ball is described with regard to FIG. 4. The valve ball 400 includes an outer surface 402 having a spherical profile that complements the inner arcuate surface 306 of the sleeve 300. The valve ball 400 also includes an actuator interface 410 to facilitate rotation of the valve ball 400 to open and close a valve that includes the valve ball 400. The valve ball 400 has an aperture 406 that aligns with the conduit 314 of the sleeve 300 when the valve is in an open state. Further, the valve ball 400 includes one or more protrusions 408 or teeth that engage one or more complementary recesses 312 of the sleeve 300 when assembled into a subassembly, as illustrated in FIG. 5.

The interlocking protrusions 408 and recesses 312 couple movement of the inner sleeve 300 to movement of the valve ball 400. Operation of the valve thereby results in simultaneous rotation of the valve ball 400 to allow flow through the conduit 314, and translational rotation of the sleeve 300 about its longitudinal axis by a preselected amount of rotation to seal annular flow entering the subassembly through the diverter plate.

Figure 6:
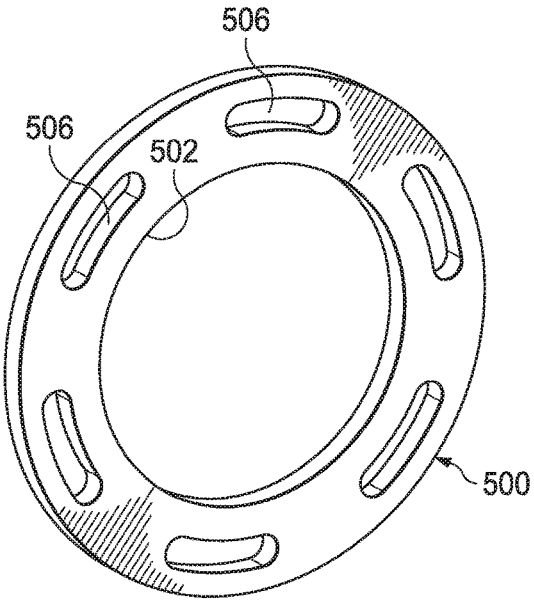
FIG. 6 illustrates a perspective view of an embodiment of a diverter used in the container subassembly of FIG. 2.

The diverter plate 500, which is shown in more detail in FIG. 6, includes a primary aperture 502 that aligns with the conduit 314 of the sleeve 300 when the two components are installed adjacent one another. The diverter plate 500 also includes diverter apertures 506 that are positioned to overlie the annulus 212 when installed in a subassembly 200. In an embodiment, the diverter plate may be formed integrally to, or partially integrally to, an outer sleeve, such as the outer sleeve 214 of FIG. 2.

While the diverter plate 500 is shown as a generally flat, planar member, the diverter plate may have any suitable shape that complements the other components of the subassembly and as such may similarly be referred to as a diverter. For example, a diverter may alternatively have an angled or arcuate surface that complements an angled or arcuate sealing surface of a sleeve to permit rotation of the sleeve relative to the diverter while maintaining the ability to form a sealed interface between the diverter and a sealing surface of the sleeve when the diverter apertures overlie the sealing surface.

In another embodiment, a diverter may comprise a staggered surface with, for example, fins and voids similar to those of the sleeve 300 described with regard to FIG. 3, whereby the fins would overlap with fins of the sleeve to form a seal to restrict flow through an annular flow path around the sleeve 300 in a first configuration. In such an embodiment, in a second configuration in which annular flow is desired, the sleeve would be rotated relative to the diverter such that the voids of the diverter overlap partially or completely with voids in the sleeve's sealing surface to allow annular flow.

Operation of the subassembly 200 is described in more detail with regard to FIGS. 7 and 8. FIG. 7 shows the subassembly in an annular flow state in which fluid flow 226 through the annulus 212 is permitted as a result of alignment of diverter apertures in the diverter plate 208 with voids or annular apertures in the flange 206 of the sleeve 202. In an embodiment, the subassembly may be deployed in the annular flow state with one or more plugs 240 stored within the main bore conduit 220 for subsequent deployment downhole upon transition of the subassembly to a main bore flow state in which flow is permitted through the conduit 220. While the embodiment of FIG. 7 shows the sleeve 202 as containing the plug 240 for controlled release downhole, it is noted that the sleeve could similarly house any other object suitable for release into the fluid flow path of the main bore.

To transition to the main bore flow state, as shown in FIG. 8, the valve 204 is actuated to open the main bore and to permit fluid through the ball of the valve 204 and through the conduit 220. As a result of engagement of teeth or protrusions of the ball engaging and exerting a translational force on the recesses or teeth of the sleeve 202, rotation of the ball of the valve 204 about the valve axis 216 causes simultaneous rotation of the sleeve 202 about the sleeve axis 218. The corresponding rotation of the sleeve 202 results in the sealing surfaces of the sleeve 202 restricting flow through the diverter apertures of the diverter plate and in turn restricting flow through the annulus 212. When transitioned to the main bore flow state, any plugs or darts previously contained within the conduit 220 would be released to flow with fluid from the subassembly to, for example, prepare a segment of the well for cementing.

It is noted that the foregoing description may be better understood with reference to the following exemplary embodiments:

In a first exemplary embodiment, a container for delivering plugs in a cementing application includes a sleeve having a first end, a second, opposing end, and defining a conduit between the first end and second, opposing end. The sleeve further includes a geared interface at the second, opposing end. In addition to the sleeve, the container includes a ball valve coupled to the second, opposing end of the sleeve. A ball of the ball valve comprises a valve-geared interface that engages the geared interface of the sleeve. The ball valve is rotatable about a first axis that is perpendicular to a longitudinal axis of the sleeve. In addition, the geared interface of the ball valve engages the geared interface of the sleeve such that rotation of the ball valve about the first axis results in rotation of the sleeve about its longitudinal axis.

In some embodiments, the sleeve has at least one sealing surface at its first end, the at least one sealing surface including at least one void disposed therein. In such an embodiment, the container further includes a diverter disposed adjacent the at least one sealing surface and having at least one diverter aperture. The container also includes an outer sleeve, and the sleeve is positioned within the outer sleeve to form an annulus between an outer surface of the sleeve and an inner surface of the outer sleeve.

The sleeve may be rotatable relative to the outer sleeve and diverter such that in a first position, the at least one diverter aperture and at least one void are aligned to permit flow through the annulus, and in a second position, the at least one diverter aperture is sealed by the at least one sealing surface.

The container of the first embodiment may further include a releasable object that is releasably stored within the conduit of the sleeve. The releasable object may be a plug, such as a cement wiper plug, a dart, or another suitable object. In an embodiment, the ball valve of the container restricts the plug from exiting the sleeve when in a first, closed position and is movable to a second, open position to permit the object to exit the sleeve. In an embodiment, the ball valve is operable to permit flow through the sleeve when in an open state and to restrict flow through the sleeve when in a closed state. In an embodiment, the second, opposing end of the sleeve comprises an arcuate inner surface having an inner profile that complements an outer profile of the valve ball of the ball valve to form a sealed interface between the sleeve and the valve ball with the valve is closed.

In accordance with a second exemplary embodiment, a system for use in a wellbore includes a sleeve having a sealing surface at a first end and a plurality of recesses at a second, opposing end. The system also includes a ball valve coupled to the second, opposing end of the sleeve, wherein a ball of the ball valve comprises a plurality of protrusions. The ball valve is rotatable about a first axis that is perpendicular to a longitudinal axis of the sleeve, and the protrusions of the ball valve engage the recesses of the sleeve such that rotation of the ball valve about the first axis results in rotation of the sleeve about its longitudinal axis.

Figure 9:
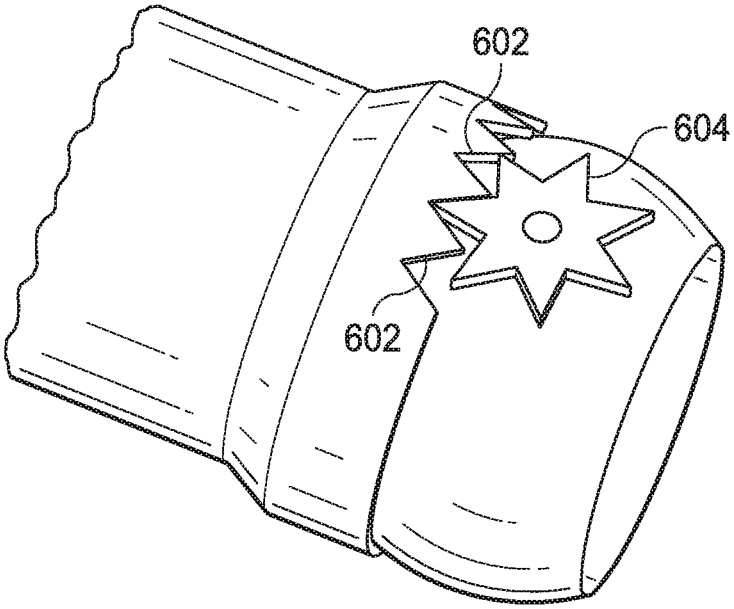
FIG. 9 illustrates a perspective view of an alternative interface between the inner sleeve of FIG. 3 and the valve ball of FIG. 4.

In such an embodiment, and as illustrated in FIG. 9, the plurality of protrusions may include valve gearing teeth 604, and the plurality of recesses include sleeve gearing teeth 602 that complement and engage the valve gearing teeth 604.

In an embodiment, the system further includes an outer sleeve, and the sleeve is positioned within the outer sleeve to form an annulus between an outer surface of the sleeve and an inner surface of the outer sleeve. In such an embodiment, the ball valve is coupled to the outer sleeve. The ball valve may be operable to permit flow through the inner sleeve when in an open state and to restrict flow through the inner sleeve when in a closed state.

The sealing surface of the sleeve may include at least one aperture, and the exemplary system may further include a diverter plate proximate the sealing surface and having at least one diverter aperture disposed therein. The sealing surface is moveable from a first position to a second position. In the first, open position, the diverter aperture and sealing surface aperture overlap to permit flow through the annulus, and the second position, the sealing surface obstructs flow through the diverter aperture to restrict flow through the annulus. In an embodiment, rotation of the ball valve from the open state causes rotation of the inner sleeve that results in movement of the sealing surface from the second, closed position to the first, open position.

In an embodiment, rotation of the ball valve from the closed state results in rotation of the inner sleeve that, in turn, results in movement of the sealing surface from the first, open position to the second, closed position.

In an embodiment, the system comprises a plurality of outer sleeves connected in series, with each outer sleeve comprising a subassembly having a sleeve, ball valve, and diverter, and each subassembly being operable to controllably release an object into a work string.

In accordance with a third exemplary embodiment, a method of alternating a flow path in a work string includes actuating a valve coupled to a rotatable sleeve such that rotation of the valve about a valve axis results in rotation of the sleeve about a longitudinal axis through the sleeve. The method also includes closing a first flow path comprising an annulus between the sleeve and an outer sleeve by rotating sealing surfaces of the sleeve to seal diverter apertures in a diverter, wherein the diverter apertures are overlying the annulus. In addition, the method includes simultaneously opening the valve to open a second flow path comprising a main bore conduit formed by the interior of the sleeve.

In an embodiment, closing the first flow path comprises moving fins of the sleeve to obstruct flow through the diverter aperture. Similarly, rotating the sealing surface of the sleeve may include the step of rotating the sleeve by conveying a translational force to the sleeve through a geared interface between the valve and the sleeve. In accordance with the method, opening the valve may include releasing a plug from the sleeve, and in an embodiment, opening the valve comprises opening a remotely actuated valve.

It should be apparent from the foregoing that embodiments of an invention having significant advantages have been provided. While the embodiments are shown in only a few forms, the embodiments are not limited but are susceptible to various changes and modifications without departing from the spirit thereof.

We claim:

1. A container for delivering plugs in a cementing application, the container comprising:

a sleeve having a first end, a second, opposing end, and defining a conduit between the first end and second, opposing end, the sleeve further comprising a geared interface at the second, opposing end; wherein the sleeve has at least one sealing surface at the first end, the at least one sealing surface including at least one void disposed therein;

a diverter disposed adjacent the at least one sealing surface and having at least one diverter aperture, an outer sleeve, wherein the sleeve is positioned within the outer sleeve to form an annulus between an outer surface of the sleeve and an inner surface of the outer sleeve, and a ball valve coupled to the second, opposing end of the sleeve, wherein a ball of the ball valve comprises a valve-geared interface that engages the geared interface of the sleeve;

wherein the ball valve is rotatable about a first axis that is perpendicular to a longitudinal axis of the sleeve;

wherein the geared interface of the ball valve engages the geared interface of the sleeve such that rotation of the ball valve about the first axis results in rotation of the sleeve about its longitudinal axis.

2. The container of claim 1, wherein the sleeve is rotatable relative to the outer sleeve and diverter such that:

in a first position, the at least one diverter aperture and at least one void are aligned to permit flow through the annulus; and in a second position, the at least one diverter aperture is sealed by the at least one sealing surface.

3. The container of claim 1, further comprising a releasable plug stored within the conduit of the sleeve.

4. The container of claim 3, wherein the ball valve restricts the plug from exiting the sleeve when in a first, closed position and is movable to a second, open position to permit the plug to exit the sleeve.

5. The container of claim 1, wherein the ball valve is operable to permit flow through the sleeve when in an open state and to restrict flow through the sleeve when in a closed state.

6. The container of claim 1, wherein the second, opposing end of the sleeve comprises an arcuate inner surface having an inner profile that complements an outer profile of the valve ball of the ball valve.

7. A system for use in a wellbore comprising:

a sleeve having a sealing surface at a first end and a plurality of recesses at a second, opposing end; wherein the sealing surface of the sleeve comprises at least one aperture;

a ball valve coupled to the second, opposing end of the sleeve, wherein a ball of the ball valve comprises a plurality of protrusions;

an outer sleeve, wherein: the sleeve is positioned within the outer sleeve to form an annulus between an outer surface of the sleeve and an inner surface of the outer sleeve; and a diverter plate proximate the sealing surface and having at least one diverter aperture;

wherein the ball valve is coupled to the outer sleeve;

wherein the ball valve is rotatable about a first axis that is perpendicular to a longitudinal axis of the sleeve;

wherein the protrusions of the ball valve engage the recesses of the sleeve such that rotation of the ball valve about the first axis results in rotation of the sleeve about its longitudinal axis;

wherein the ball valve is operable to permit flow through the inner sleeve when in an open state and to restrict flow through the inner sleeve when in a closed state; and wherein the sealing surface is moveable from a first petition to a second position, wherein, in the first, open position, the diverter aperture and sealing surface aperture overlap to permit flow through the annulus, and in the second, closed position, the sealing surface obstructs flow through the diverter aperture to restrict flow through the annulus.

8. The system of claim 7, wherein the plurality of protrusions comprise valve gearing teeth, and wherein the plurality of recesses comprise sleeve gearing teeth that complement and engage the valve gearing teeth.

9. The system of claim 7, wherein rotation of the ball valve from the open state causes rotation of the inner sleeve that results in movement of the sealing surface from the second, closed position to the first, open position.

10. The system of claim 7, wherein rotation of the ball valve from the closed state causes rotation of the inner sleeve that results in movement of the sealing surface from the first, open position to the second, closed position.

11. The system of claim 10, further comprising a plurality of outer sleeves connected in series, each outer sleeve comprising a subassembly having a sleeve, ball valve, and diverter, and wherein each subassembly is operable to controllably release an object into a work string.

12. A method of alternating a flow path in a work string, the method comprising:

actuating a valve coupled to a rotatable sleeve such that rotation of the valve about a valve axis results in rotation of the sleeve about a longitudinal axis through the sleeve;

closing a first flow path comprising an annulus between the sleeve and an outer sleeve by rotating sealing surfaces of the sleeve to seal diverter apertures in a diverter, the diverter apertures overlying the annulus; and simultaneously opening the valve to open a second flow path comprising a main bore conduit formed by the interior of the sleeve.

13. The method of claim 12, wherein closing the first flow path comprises moving fins of the sleeve to obstruct flow through the diverter aperture.

14. The method of claim 12, wherein rotating the sealing surface of the sleeve comprises rotating the sleeve by conveying a translational force to the sleeve through a geared interface between the valve and the sleeve.

15. The method of claim 12, wherein opening the valve comprises releasing a plug from the sleeve.

16. The method of claim 12, wherein the valve comprises a remotely actuated valve.

* * * * *